US010919315B1

(12) United States Patent
Kitahara

(10) Patent No.: US 10,919,315 B1
(45) Date of Patent: Feb. 16, 2021

(54) PRINTER

(71) Applicant: TOSHIBA TEC KABUSHIKI KAISHA, Tokyo (JP)

(72) Inventor: Satoshi Kitahara, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/567,740

(22) Filed: Sep. 11, 2019

(51) Int. Cl.
*B41J 2/325* (2006.01)
*B41J 33/10* (2006.01)

(52) U.S. Cl.
CPC ..... *B41J 2/325* (2013.01); *B41J 33/10* (2013.01)

(58) Field of Classification Search
CPC ... B41J 2/325; B41J 33/10; B41J 33/14; B41J 2202/31
See application file for complete search history.

(56) References Cited

U.S. PATENT DOCUMENTS 7,791,627 B2 * 9/2010 Sakurai ..... B41J 33/52 347/219

FOREIGN PATENT DOCUMENTS

JP H08-2078 A 1/1996

* cited by examiner

*Primary Examiner* — Thinh H Nguyen
(74) *Attorney, Agent, or Firm* — Kim & Stewart LLP

(57) ABSTRACT

A printer includes a thermal print head, a supply shaft, a winding shaft, a light emitting device, and a photodetector. The light emitting device and the photodetector are aligned along a line parallel to a line passing through rotational axes of the supply and winding shafts at a predetermined distance. The predetermined distance is greater than a radius of the supply shaft and a radius of the winding shaft. The predetermined distance is less than a radial distance from the rotational axis of the supply shaft to an outer surface of the ink ribbon on the supply shaft and a radial distance from the rotational axis of the winding shaft to an outer surface of the ink ribbon on the winding shaft when a length of the ribbon on the supply shaft is equal to a length of the ribbon on the winding shaft.

20 Claims, 5 Drawing Sheets

FIG.5

| WINDING SPECIFICATION | RIBBON LENGTH (m) | RIBBON DIAMETER (ϕ) | RIBBON DIAMETER AT THE TIME OF INTERMEDIATE RIBBON LENGTH | DISTANCE FROM RIBBON CENTER |
|---|---|---|---|---|
| MAXIMUM SPECIFICATION | 900 | 106 | 78 | 39 |
| MINIMUM SPECIFICATION | 300 | 66 | 51 | 25.5 |

FIG.6

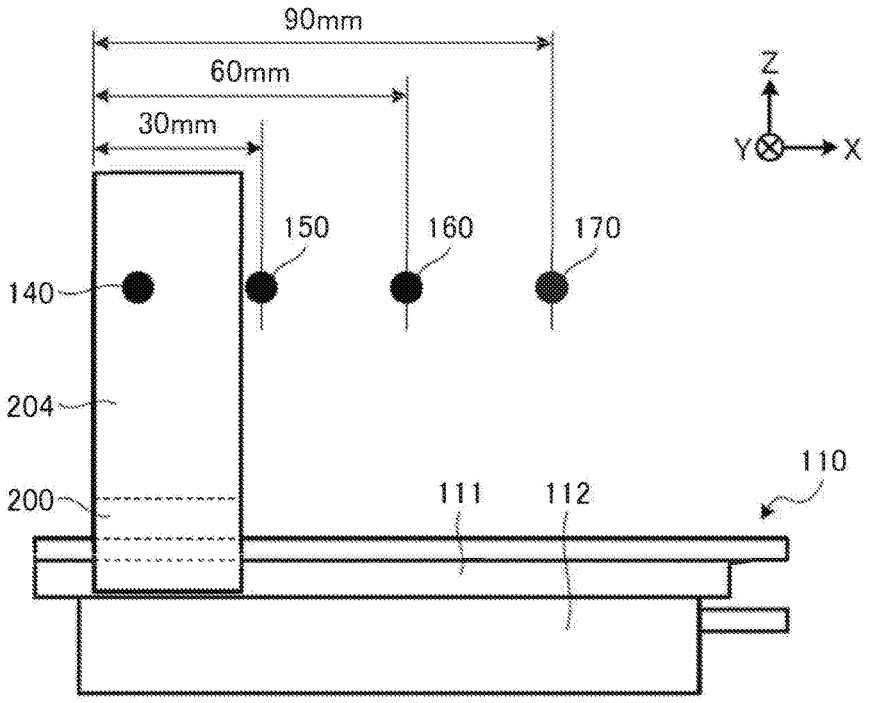

FIG.7

| SENSOR DETECTION | | | | RIBBON WIDTH | STANDARD CONTROL |
|---|---|---|---|---|---|
| SENSOR 0 | SENSOR 1 | SENSOR 2 | SENSOR 3 | | |
| TRANSMISSION | TRANSMISSION | TRANSMISSION | TRANSMISSION | NO RIBBON | NON-OPERATION |
| NON-TRANSMISSION | TRANSMISSION | TRANSMISSION | TRANSMISSION | MINIMUM WIDTH ~ 30 | 1/4 TORQUE |
| NON-TRANSMISSION | NON-TRANSMISSION | TRANSMISSION | TRANSMISSION | 30 ~ 60 | 1/2 TORQUE |
| NON-TRANSMISSION | NON-TRANSMISSION | NON-TRANSMISSION | TRANSMISSION | 60 ~ 90 | 3/4 TORQUE |
| NON-TRANSMISSION | NON-TRANSMISSION | NON-TRANSMISSION | NON-TRANSMISSION | 90 ~ MAXIMUM WIDTH | REFERENCE TORQUE |

PRINTER

FIELD

Embodiments described herein relate generally to a printer.

BACKGROUND

A printer that performs printing using an ink ribbon detects the presence or absence of the ink ribbon along with a width and a diameter of the ink ribbon at the time of printing. The printer performs control to make the tension of the ink ribbon appropriate according to a detection result. It is possible to tension the ink ribbon uniformly without slack or wrinkles to obtain a better printing result. An optical sensor (whether a transmission type or a reflection type sensor) or a rotary encoder can be used as a detection section for detecting ink ribbon parameters.

A conventional detection section using an optical sensor emits light to an outer peripheral surface of the ink ribbon from a direction orthogonal to a rotation axis of the ink ribbon wound around a shaft, and detects the presence or absence and the width of the ink ribbon from the presence or absence of received light at a predetermined position. The ink ribbon is wound around shafts on both a supplying side and a winding side, and typically in detection sections using optical sensors, just one of the ink ribbon on the supplying side or the ink ribbon on the winding side is used as a detection target.

A conventional detection section using a rotary encoder is arranged, for example, on at least one of a winding shaft and a supply shaft of the ink ribbon, and calculates a diameter of the ink ribbon from a rotation angle of a slit plate with respect to a conveyance length of the ink ribbon. Such a detection section is also used to detect the presence or absence of the ink ribbon because it can be determined that the ink ribbon is not mounted if the rotation of the slit plate caused by feeding the ink ribbon is not detected.

In a conventional detection section using the optical sensor, it may be necessary to distinguish between the shaft around which the ink ribbon is wound and the ink ribbon itself. However, since it is difficult to distinguish between the ink ribbon and the shaft when the amount of the ink ribbon is small, there is a problem that detection accuracy in such a state is low.

In a conventional detection section using a rotary encoder, since rotation of the slit plate is typically necessary, there is a problem that the detection result cannot be obtained before starting the conveying of the ink ribbon (for example, actually starting a printing operation).

From these reasons, it is desirable that a printer can detect the ink ribbon with high accuracy regardless of a state of use of the ink ribbon as well as before a printing operation has been started.

DESCRIPTION OF THE DRAWINGS

FIG. 5 is a table for summarizing examples of a ribbon length, a ribbon diameter, a ribbon diameter at the time of intermediate ribbon length and a distance from a ribbon center for the ink ribbons of both a maximum specification and a minimum specification.

FIG. 6 is a diagram illustrating a configuration for detecting a width of the ink ribbon.

FIG. 7 is a table summarizing a ribbon width and a standard control torque determined from a sensor detection pattern.

DETAILED DESCRIPTION

According to an embodiment, a printer includes a thermal print head, a supply shaft around which an ink ribbon is wound, a winding shaft around which the ink ribbon is wound after passing the thermal print head, a first light emitting device, and a first photodetector. The first light emitting device and the first photodetector are aligned along a first line parallel to a second line passing a rotational axis of the supply shaft and a rotational axis of the winding shaft at a predetermined distance from the second line. The predetermined distance being greater than each of a radius of the supply shaft and a radius of the winding shaft. The predetermined distance is less than a radial distance from the rotational axis of the supply shaft to an outer surface of the ink ribbon on the supply shaft and a radial distance from the rotational axis of the winding shaft to an outer surface of the ink ribbon on the winding shaft when a length of the ink ribbon wound on the supply shaft is equal to a length of the ink ribbon wound on the winding shaft.

Hereinafter, example embodiments of a printer according to the present disclosure are described with reference to the accompanying drawings. For convenience of description, three axes (three-dimensional orthogonal coordinate system) are shown in FIG. 1 to FIG. 3 and FIG. 6. The present disclosure also includes, as one example, a labeling apparatus. These depicted examples do not limit the present disclosure. In some contexts, an ink ribbon 200 may be simply be or be referred to as a "ribbon" with or without ink thereon.

Figure 1:
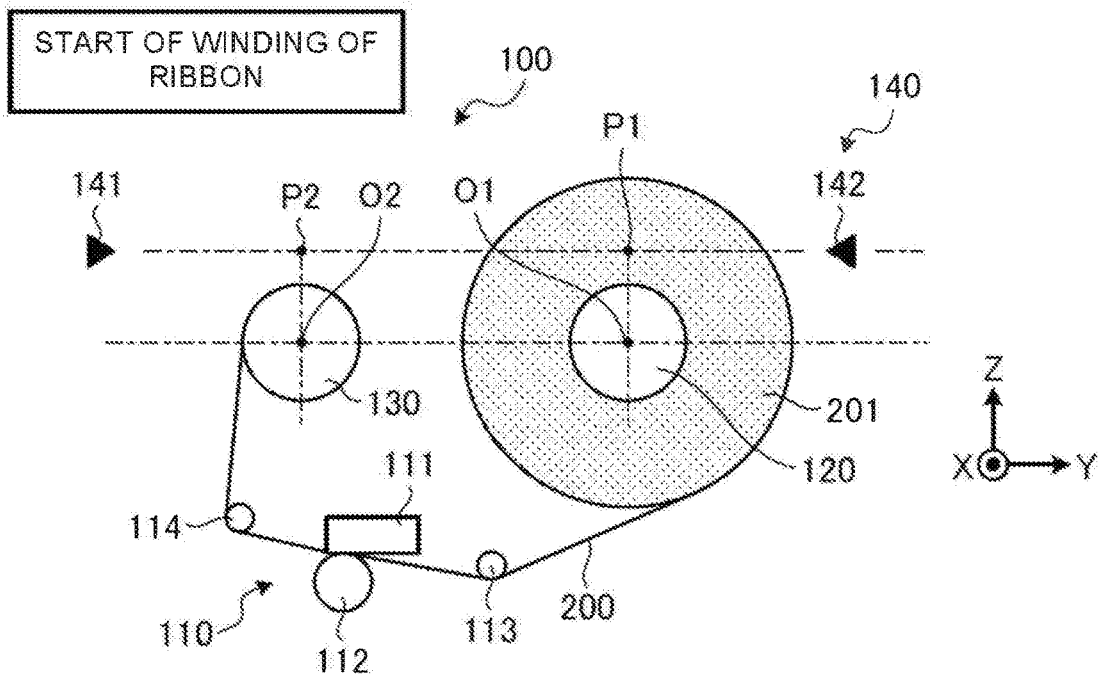
FIG. 1 is a diagram schematically illustrating a configuration of a printer according to an embodiment in a state at the start of winding of an ink ribbon.
Figure 2:
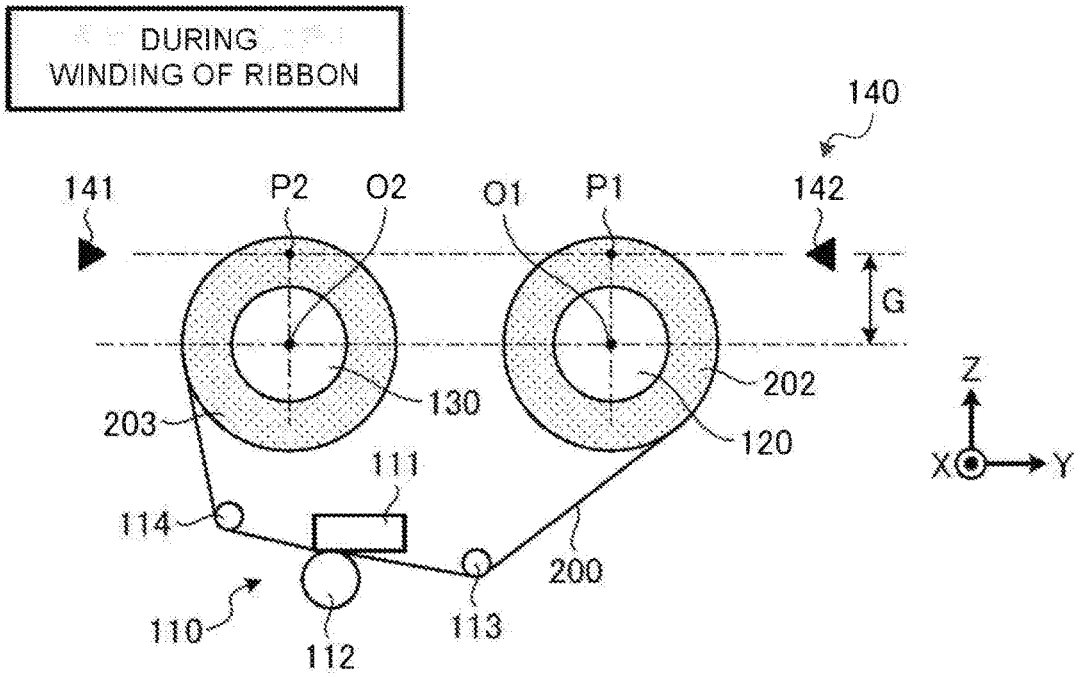
FIG. 2 is a diagram schematically illustrating the configuration of the printer in a state during the winding of the ink ribbon.
Figure 3:
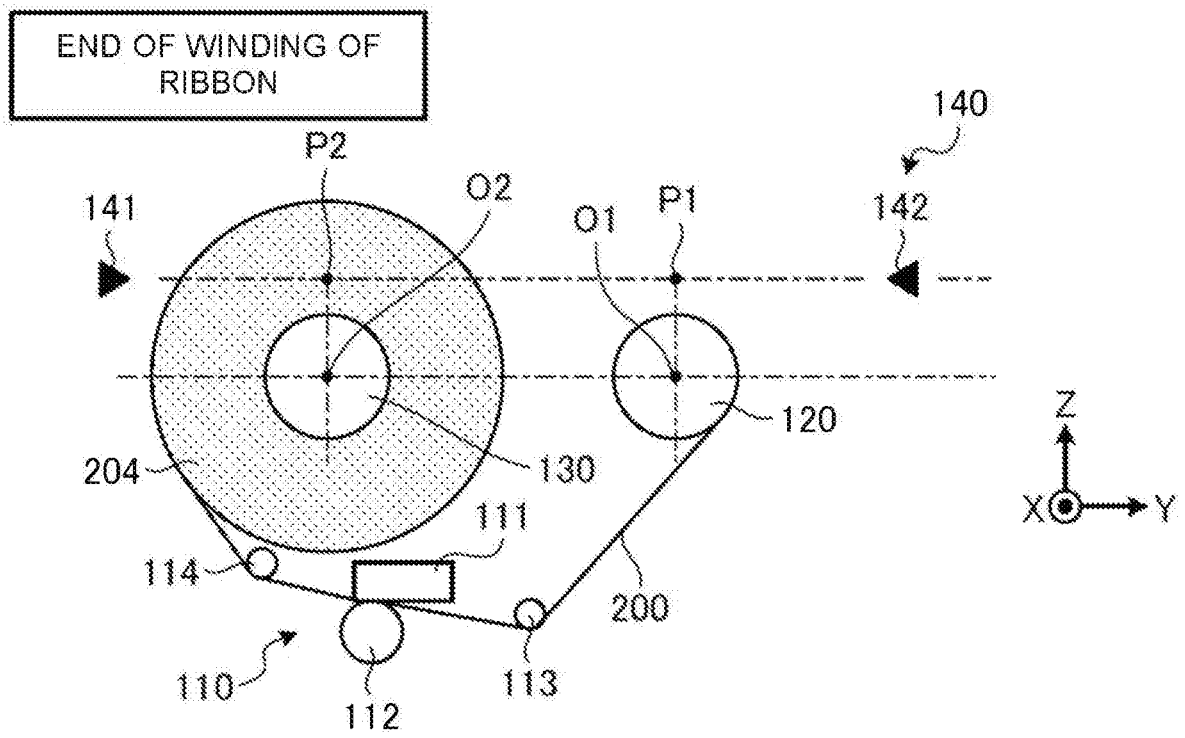
FIG. 3 is a diagram schematically illustrating the configuration of the printer in a state at the end of the winding of the ink ribbon.

FIG. 1 to FIG. 3 are diagrams schematically illustrating a configuration of a printer 100 according to an embodiment. FIG. 1 is a diagram illustrating a state at the start of winding of the ink ribbon 200. FIG. 2 is a diagram illustrating a state during the winding of the ink ribbon 200. FIG. 3 is a diagram illustrating a state at the end of the winding of the ink ribbon 200.

The ink ribbon 200 contains an ink that is melted when heated. The printer 100 includes a printing section 110, a supply shaft 120, a winding shaft 130, and a detection section 140.

The printing section 110 includes a thermal head 111 and a platen roller 112, and a print medium and the ink ribbon 200 are sandwiched between the thermal head 111 and the platen roller 112. The print medium is, for example, a sheet such as paper or film.

The platen roller 112 is an example of a platen, and is rotated by a force from a motor to convey the print medium and the ink ribbon 200. The thermal head 111 is an example of a print head, and includes a plurality of heat generation elements. The plurality of heat generation elements is aligned in a direction (width direction) orthogonal to a conveyance direction of the print medium and the ink ribbon 200, and generates heat to melt the ink contained in the ink ribbon 200. The melted ink adheres to the print medium. In this way, the printing section 110 performs printing on the print medium using the ink contained in the ink ribbon 200.

The printing section 110 includes auxiliary rollers 113 and 114. The auxiliary roller 113 and the auxiliary roller 114 are arranged at positions sandwiching the thermal head 111 and the platen roller 112 from an upstream side and a downstream side in the conveyance direction of the ink ribbon 200. The auxiliary rollers 113 and 114 keep an angle of a portion of the ink ribbon 200 between the thermal head 111 and the platen roller 112 at a constant level.

The supply shaft 120 holds rolls 201 and 202 (refer to FIG. 1 and FIG. 2; an example of holding targets) around which the ink ribbon 200 is wound in such a manner that the ink ribbon 200 can be pulled out. The winding shaft 130 winds the ink ribbon 200 passing through the printing section 110, and holds the ink ribbon 200 as rolls 203 and 204 (refer to FIG. 2 and FIG. 3; an example of holding targets).

With respect to an axis center O1 and an axis center O2 of the supply shaft 120 and the winding shaft 130 holding the ink ribbon 200, the printing section 110 deviates in a negative direction of a Z axis, and the detection section 140 deviates in a positive direction of the Z axis. In other words, the printing section 110 and the detection section 140 are opposite to each other across the supply shaft 120 and the winding shaft 130. Due to such an arrangement, the presence of the printing section 110 does not affect the detection result of the detection section 140.

If a light receiving section 142 (e.g., photodetector) does not receive light emitted from a light emitting section 141 of a transmission optical sensor, the detection section 140 detects the presence of the ink ribbon 200. The light emitting section 141 and the light receiving section 142 are arranged in such a manner that the light emitted from the light emitting section 141 reaches the light receiving section 142 after passing through two positions (point P1 and point P2 in a YZ plane).

The above points P1 and P2 are described with reference to FIG. 2 and correspond to the state during the winding of the ink ribbon. The points P1 and P2 are separated from axis centers O1 and O2 by a distance G along a positive direction of the Z axis.

The point P1 is positioned on an inner side with respect to an outer peripheral surface of the roll 202 which is a pull-out source by a predetermined dimension at the time half of the ink ribbon 200 having the smallest diameter in an unused state is used. The point P2 is positioned on an inner side with respect to an outer peripheral surface of the roll 203 which is a winding destination by a predetermined dimension at the time half of the ink ribbon 200 having the smallest diameter in the unused state is used. The time at which the half is used refers to a time at which the ink ribbon 200 is held equally by the supply shaft 120 and the winding shaft 130, i.e., a time at which the diameters of the roll 202 and the roll 203 are equal to each other.

FIG. 5 is a table summarizing examples of a ribbon length, a ribbon diameter, a ribbon diameter at the time of intermediate ribbon length, and a distance from the ribbon center for the ink ribbons of both a maximum specification and a minimum specification.

Here, the "ribbon length" label refers to the entire length of the ink ribbon 200 in the unused state. The "ribbon diameter" label refers to a diameter of the ink ribbon 200 in the unused state. The "ribbon diameter at the time of intermediate ribbon length" label refers to the diameter of the ink ribbon 200 when the half has been used while the other half is still left. The "distance from the ribbon center" label refers to a length from the axis center point to the outer peripheral surface of the ink ribbon 200 when the half is used while the other half is still left.

For the ink ribbon 200 at the maximum specification, for example, the ribbon length thereof is 900 m, the ribbon diameter thereof is 106 mm, the ribbon diameter at the time of the intermediate ribbon length thereof is 78 mm, and the distance from the ribbon center thereof is 39 mm. For the ink ribbon 200 of the minimum specification, for example, the ribbon length thereof is 300 m, the ribbon diameter thereof is 66 mm, the ribbon diameter at the time of the intermediate ribbon length thereof is 51 mm, and the distance from the ribbon center thereof is 25.5 mm.

When the ink ribbon 200 used by the printer 100 has the above specifications, a preferable value for the distance G shown in FIG. 2 is, for example, 25 mm. This value is 0.5 mm smaller than 25.5 mm which is the "distance from the ribbon center" of the ink ribbon 200 of the minimum specification. This 0.5 mm is an example of a "predetermined dimension". This "predetermined dimension" is desirably a value used to facilitate discrimination between the shafts 120 and 130 and the rolls 202 and 203 (refer to FIG. 2), and more specifically, is a value between the radiuses of the rolls 202 and 203 and the radiuses of the shafts 120 and 130.

As can be known from FIG. 1 to FIG. 3, in the present embodiment, one roll 201 (refer to FIG. 1) or 204 (refer to FIG. 3) or two rolls 202 and 203 (refer to FIG. 2) are positioned between the light emitting section 141 and the light receiving section 142. This means that if the ink ribbon 200 is set around the supply shaft 120 and the winding shaft 130, the ink ribbon 200 is always detected by the detection section 140 regardless of the state of use.

Figure 4:
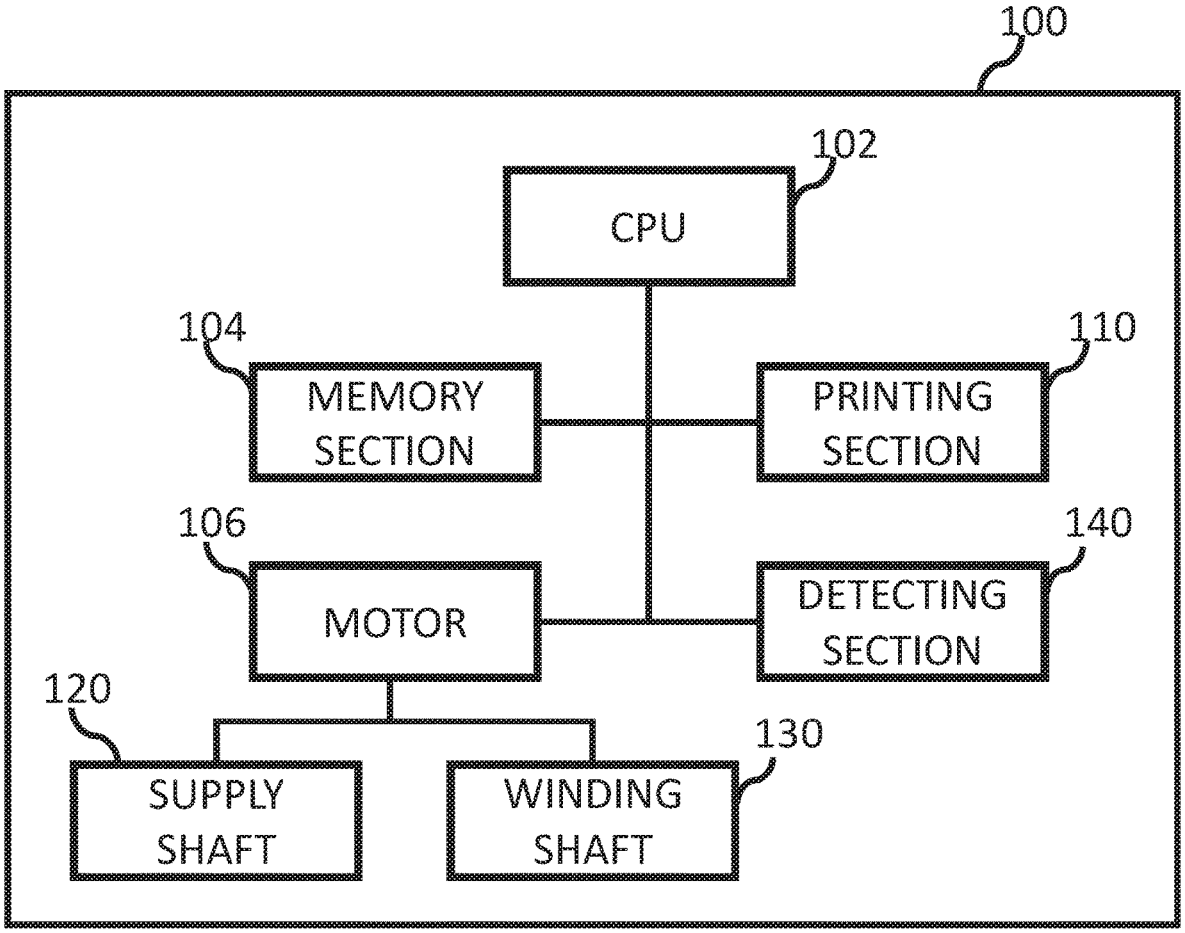
FIG. 4 is a block diagram schematically illustrating the configuration of the printer.

As shown in FIG. 4, the printer 100 comprises the printing section 110, the CPU 102 (processor), a memory section 104, a motor 106 and the detecting section 140.

The CPU 102 is mutually connected with the printing section 110, the memory section 104, the motor 106, and the detecting section 140 via a data bus.

The CPU 102 controls the entire printer 100. The CPU 102 may include an internal cache and various interfaces. The CPU 102 executes a program stored in advance in the internal memory or the memory section 104 to perform various kinds of processing. The CPU 102 may be any processor as long as it can perform control of each section of the printer 100 and information processing by executing a program.

Apart of the various functions performed by the CPU 102 through executing the program may be performed by a hardware circuit. In this case, the CPU 102 controls the functions performed by the hardware circuit.

The memory section 32 is composed of a volatile memory and a nonvolatile memory. For example, the memory section 104 stores control programs, control data, and the like in advance. The memory section 32 temporarily stores data being processed by the CPU 102. For example, the memory section 104 stores various application programs that is executed based on a command from the CPU 102. The memory section 32 may also store data required for executing the application program and an execution result of the application program.

The motor 106 drives each section of the printer 1 according to a signal from the CPU 102. For example, the motor 106 drives the supply shaft 120 and the winding shaft 130.

Next, the function performed by the CPU 102 is described. The CPU 102 performs a function of controlling the torque applied to the supply shaft 120 and/or the winding shaft 130.

More specifically, in the state shown in FIG. 1, the roll 201 is held by the supply shaft 120. FIG. 1 shows the state at the beginning of the winding of the ink ribbon 200. In other words, the roll 201 has the maximum diameter in a state in which the ink ribbon 200 is not used yet. At this time, since the ink ribbon 200 is not wound around the winding shaft 130, the light emitted from the light emitting section 141 is blocked only by the roll 201. Since the roll 201 blocks the light and the light receiving section 142 does not receive the light, the detection section 140 detects the presence of the ink ribbon 200.

Next, in the state in FIG. 3, the roll 204 is held around the winding shaft 130. FIG. 3 shows the state at the end of winding of the ink ribbon 200. In other words, the roll 204 has the maximum diameter in the state in which the ink ribbon 200 is used up at the last. At this time, since the ink ribbon 200 is not wound around the supply shaft 120, the light emitted from the light emitting section 141 is blocked only by the roll 204. Since the roll 204 blocks the light and the light receiving section 142 does not receive the light, the detection section 140 detects the presence of the ink ribbon 200.

Next, in the state in FIG. 2, the ink ribbon 200 is equally held around the supply shaft 120 and the winding shaft 130. In other words, the roll 202 and the roll 203 have the same diameter. At this time, the light emitted from the light emitting section 141 is blocked by the roll 202 and the roll 203. The detection section 140 detects the presence of the ink ribbon 200 since the rolls 202 and 203 block the light and the light receiving section 142 does not receive the light.

The ink ribbon 200 enters the state shown in FIG. 3 after the state shown in FIG. 2 from the state shown in FIG. 1. Therefore, as long as the ink ribbon 200 is placed in the printer 100, the detection section 140 can reliably detect the presence of the ink ribbon 200 regardless of the state of use of the ink ribbon 200. In the detection, conveyance of the ink ribbon 200 (rotation of the shafts 120 and 130) is unnecessary.

It is sometimes necessary to adjust the tension of the ink ribbon 200 to obtain a better printing result by tensioning the ink ribbon uniformly without slack or wrinkles. In order to adjust the tension of the ink ribbon 200, it is preferable to apply a torque corresponding to the width of the ink ribbon 200 to the supply shaft 120 and/or the winding shaft 130. This is because, if a torque that has not been adjusted according to the particular width of the ink ribbon 200 is applied to the supply shaft 120 or the winding shaft 130, problems may occur such as the force applied per unit width of the ink ribbon 200 may become excessive when the width is narrow or insufficient when the width is wide. To handle these issues, the printer 100 according to the present embodiment controls the torque applied to the supply shaft 120 and/or the winding shaft 130 according to the width of the ink ribbon 200.

The supply shaft 120 and the winding shaft 130 are respectively rotated by the force from a motor 106. The motor 106 is, for example, a DC motor, and in this case, the printer 100 changes the torque to be applied to each of the shafts 120 and 130 by the motor 106 by changing a voltage applied to the motor in the above-described control. The diameters of the rolls 201 to 204 and the width of the ink ribbon 200 are important for the control. In the present disclosure, a detection of the width of the ink ribbon 200 is described.

FIG. 6 is a diagram illustrating a configuration for detecting the width of the ink ribbon 200. FIG. 6 shows the state of FIG. 3 as viewed in the Y axis direction. The printer 100 further includes detection sections 150, 160, and 170 having the same configuration as that of the detection section 140 described above. The detection sections 150, 160, and 170 are examples of a second detection section.

The detection section 140 detects the presence of the ink ribbon 200 when the light receiving section 142 does not receive the light emitted from the light emitting section 141 of the transmission optical sensor. Similarly, the detection sections 150, 160, and 170 also detect the presence of the ink ribbon 200 when light receiving sections thereof do not receive the light emitted from light emitting sections of transmission optical sensors.

In FIG. 6, the width direction of the ink ribbon 200 is parallel to the X axis direction. The position in the X axis direction of the detection section 140 is a position having a distance shorter than the width of the ink ribbon 200 having the minimum width. The detection section 150 is arranged at a position of 30 mm in the X axis direction. The detection section 160 is arranged at a position of 60 mm in the X axis direction. The detection section 170 is arranged at a position of 90 mm in the X axis direction.

In such a configuration, if it is assumed that one side end of the ink ribbon 200 is positioned at a position of 0 mm in the X axis direction, the other side end of the ink ribbon 200 is positioned at a position corresponding to the width of the ink ribbon 200. For example, an ink ribbon 200 of which the ribbon width is equal to or larger than the minimum width and less than 30 mm can be detected by the detection section 140 but cannot be detected by the detection sections 150, 160, and 170. In this manner, the printer 100 estimates the ribbon width from the detection results from the detection sections 140, 150, 160, and 170, and applies torque corresponding to the ribbon width to each of the shafts 120 and 130.

FIG. 7 is a table summarizing the ribbon width and a corresponding standard control torque determined from a sensor detection pattern. For convenience of description, hereinafter, the optical sensor of the detection section 140 is referred to as a sensor 0, the optical sensor of the detection section 150 is referred to as a sensor 1, the optical sensor of the detection section 160 is referred to as a sensor 2, and the optical sensor of the detection section 170 is referred to as a sensor 3.

The "reference torque" for the standard control is a torque suitable for the ink ribbon 200 having the maximum width. Further, the reference torque can be changed depending on the diameter of the ink ribbon 200 wound around each of the shafts 120 and 130. Further, the reference torque may be different depending on the shafts 120 and 130. For example, the reference torque of the winding shaft 130 may be greater than the reference torque of the supply shaft 120.

In the present embodiment, the control is performed to change the torque stepwise according to the ribbon width. In practice, the control may be performed to change the torque in proportion to the ribbon width rather than step-wise.

In the example shown in FIG. 6, if all of the sensors 0 to 3 are in a state of "transmission" (light is detected), the ribbon width is considered to be "no ribbon", i.e., no ink ribbon 200 is present; and the standard control is set to a "non-operation" state in which the printer 100 does not apply the torque to each of the shafts 120 and 130.

In the example shown in FIG. 6, if only the sensor 0 is in a state of "non-transmission" (light is not detected) and the sensors 1 to 3 are in the state of "transmission", the ribbon width is equal to or lager than a minimum width and less than 30 mm. At this time, the printer 100 applies a torque which is ¼ of the "reference torque" to each of the shafts 120 and 130.

In the example shown in FIG. 6, if the sensors 0 and 1 are in the state of "non-transmission" and the sensors 2 and 3 are in the state of "transmission", the ribbon width is equal to or larger than 30 mm and less than 60 mm. At this time, the printer 100 applies a torque which is half of the "reference torque" to each of the shafts 120 and 130.

In the example shown in FIG. 6, if the sensors 0 to 2 are in the state of "non-transmission" and the sensor 3 is in the state of "transmission", the ribbon width is equal to or lager than 60 mm and less than 90 mm. At this time, the printer 100 applies a torque which is ¾ of the "reference torque" to each of the shafts 120 and 130.

In the example shown in FIG. 6, if all of the sensors 0 to 3 are in the state of "non-transmission", the ribbon width is equal to or larger than 90 mm and equal to or smaller than the maximum width. At this time, the printer 100 applies the "reference torque" to each of the shafts 120 and 130.

According to the embodiment as described above, as long as the ink ribbon 200 is set in the printer 100, the presence of the ink ribbon 200 can be reliably detected without requiring the conveying of the ink ribbon 200 regardless of the status of use of the ink ribbon 200. Therefore, in the printer 100, by performing control to detect the ink ribbon at the time of energization, an error caused by the absence of the ink ribbon 200 can be notified before the start of printing.

According to the embodiment, the width of the ink ribbon 200 can be determined, and the torque corresponding to the width of the ink ribbon 200 can be applied to each of the shafts 120 and 130. As a result, the ink ribbon 200 can be tensioned uniformly without slack and wrinkles, and a better printing result can be obtained.

As described above, while certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

For example, in an above embodiment, each of the detection sections 140, 150, 160, and 170 has a light emitting section paired with a light receiving section; however, in practice, the light emitting sections of the detection sections 140, 150, 160, and 170 may be combined, i.e., a plurality of the light receiving sections may be arranged to face a single light emitting section. Even with such a configuration, it is possible to achieve the substantially the same effect as the configuration of FIG. 6.

Although four detection sections 140, 150, 160, and 170 are arranged in the above-described embodiment, the number of detection sections is not limited thereto and the number may be greater or lesser than four. For example, two detection sections may be arranged to discriminate the ink ribbon in two stages such as an ink ribbon having a relatively narrow width and an ink ribbon having relatively wide width.

In the above-described embodiment, the presence and the width of the ink ribbon 200 are both detected; however, if only the width of the ink ribbon needs to be detected, the detection section 140 shown in FIG. 6 may be unnecessary. In this case, the table summarizing the ribbon width and the standard control torque determined from the sensor detection pattern shown in FIG. 7 may be used by excluding the column corresponding to "sensor 0" and the row in which the ribbon width is "no ribbon" from the table.

What is claimed is:

1. A printer, comprising:

a thermal print head;

a supply shaft around which an ink ribbon is wound;

a winding shaft around which the ink ribbon is wound after passing the thermal print head; and a first light emitting device and a first photodetector aligned along a first line parallel to a second line passing through a rotational axis of the supply shaft and a rotational axis of the winding shaft, the first line being at a predetermined distance from the second line, the predetermined distance being greater than each of a radius of the supply shaft and a radius of the winding shaft, and less than a radial distance from the rotational axis of the supply shaft to an outer surface of the ink ribbon on the supply shaft and a radial distance from the rotational axis of the winding shaft to an outer surface of the ink ribbon on the winding shaft when a length of the ink ribbon wound on the supply shaft is equal to a length of the ink ribbon wound on the winding shaft.

2. The printer according to claim 1, wherein the first light emitting device and the first photodetector are located on a side of the second line opposite to a side on which the thermal print head is located.

3. The printer according to claim 1, wherein the first light emitting device and the first photodetector are located such that at least one of the ink ribbon wound on the supply shaft and the ink ribbon on the winding shaft blocks light directed from the first light emitting device toward the first photodetector throughout conveyance of the ink ribbon from the supply shaft to the winding shaft.

4. The printer according to claim 1, further comprising:

a second light emitting device and a second photodetector aligned along the first line, the second light emitting device being shifted from the first light emitting device in a width direction of the ink ribbon, and the second photodetector being shifted from the first photodetector in the width direction of the ink ribbon.

5. The printer according to claim 4, further comprising:

a controller configured to cause a first torque to be applied to the supply shaft when the first photodetector does not detect light and the second photodetector detects light, and a second torque greater than the first torque to be applied to the winding shaft when both the first and second photodetectors do not detect light.

6. The printer according to claim 5, wherein the controller is further configured to cause no torque to be applied to the winding shaft when the first photodetector detects light.

7. The printer according to claim 4, further comprising:

a third light emitting device and a third photodetector aligned along the first line, the third light emitting device being shifted from the second light emitting device in the width direction of the ink ribbon, and the third photodetector being shifted from the second photodetector in the width direction of the ink ribbon.

8. The printer according to claim 7, further comprising:

a controller configured to cause a first torque to be applied to the winding shaft when the first photodetector does not detect light and the second and third photodetectors detect light, and a second torque greater than the first torque to be applied to the winding shaft when both the first and second photodetectors do not detect light and the third photodetector detects light.

9. The printer according to claim 8, wherein the controller is further configured to cause a third torque greater than the second torque to be applied to the winding shaft when all of the first, second, and third photodetectors do not detect light.

10. The printer according to claim 9, wherein the controller is further configured to prevent torque from being applied to the winding shaft when the first photodetector detects light.

11. A printer, comprising:

a thermal print head;

a supply shaft around which a first portion of an ink ribbon is wound;

a winding shaft around which a second portion of the ink ribbon that has passed the thermal print head is wound; and a first light emitting device and a first photodetector that are located such that at least one of the first portion and the second portion of the ink ribbon blocks light directed from the first light emitting device toward the first photodetector throughout a conveyance of the ink ribbon from the supply shaft to the winding shaft.

12. The printer according to claim 11, wherein the first light emitting device and the first photodetector are located on a side of a line passing a rotational axis of the supply shaft and a rotational axis of the winding shaft, the side being opposite to a side on which the thermal print head is located.

13. The printer according to claim 12, further comprising:

a second light emitting device shifted from the first light emitting device in a width direction of the ink ribbon, and a second photodetector shifted from the first photodetector in the width direction of the ink ribbon.

14. The printer according to claim 13, further comprising:

a controller configured to cause a first torque to be applied to the winding shaft when the first photodetector does not detect light and the second photodetector detects light, and a second torque greater than the first torque to be applied to the winding shaft when both the first and second photodetectors do not detect light.

15. The printer according to claim 14, wherein the controller is further configured to prevent torque from being applied to the winding shaft when the first photodetector detects light.

16. The printer according to claim 13, further comprising:

a third light emitting device shifted from the second light emitting device in the width direction of the ink ribbon, and a third photodetector shifted from the second photodetector in the width direction of the ink ribbon.

17. The printer according to claim 16, further comprising:

a controller configured to cause a first torque to be applied to the winding shaft when the first photodetector does not detect light and the second and third photodetectors detect light, and a second torque greater than the first torque to be applied to the winding shaft when both the first and second photodetectors do not detect light and the third photodetector detects light.

18. The printer according to claim 17, wherein the controller is further configured to cause a third torque greater than the second torque to be applied to the winding shaft when all of the first, second, and third photodetectors do not detect light.

19. The printer according to claim 18, wherein the controller is further configured to prevent torque from being applied to the winding shaft when the first photodetector detects light.

20. A printer, comprising:

a printing section configured to perform printing using an ink ribbon;

a supply shaft configured to hold the ink ribbon in a wound state;

a winding shaft configured to hold the ink ribbon in a wound state after the ink ribbon has been unwound from the supply shaft and passed through the printing section; and a detection section configured to detect a presence of the ink ribbon and including a light emitting section aligned with an optical sensor along a line that passes through a position a predetermined distance from a rotational axis of each of the supply shaft and the winding shaft, the predetermined distance being greater than each of a radius of the supply shaft and a radius of the winding shaft and equal to or less than a radial distance from the supply shaft to an outer peripheral surface of the ink ribbon held on the winding shaft after one-half of an initial amount of the ink ribbon on the supply shaft has been passed through printing section and wound on the winding shaft.

* * * * *